US010435264B2

(12) United States Patent
Nishiyama

(10) Patent No.: US 10,435,264 B2
(45) Date of Patent: Oct. 8, 2019

(54) IMAGE FORMING APPARATUS, METHOD FOR CONTROLLING IMAGE FORMING APPARATUS, AND NON-TRANSITORY COMPUTER READABLE MEDIUM

(71) Applicant: CANON KABUSHIKI KAISHA, Tokyo (JP)

(72) Inventor: Kaori Nishiyama, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/936,510

(22) Filed: Mar. 27, 2018

(65) Prior Publication Data

US 2018/0305156 A1 Oct. 25, 2018

(30) Foreign Application Priority Data

Apr. 24, 2017 (JP) ..... 2017-085338

(51) Int. Cl.
*B65H 1/04* (2006.01)
*B65H 7/20* (2006.01)
(Continued)

(52) U.S. Cl.
CPC ..... *B65H 7/20* (2013.01); *B41J 11/0095* (2013.01); *B41J 13/0018* (2013.01); *B41J 13/0054* (2013.01); *B41J 13/103* (2013.01); *B65H 1/04* (2013.01); *B65H 7/06* (2013.01); *B65H 2220/02* (2013.01); *B65H 2301/211* (2013.01);
(Continued)

(58) Field of Classification Search
CPC ... B65H 7/20; B65H 1/04; B65H 7/06; B65H 2220/02; B65H 2301/211; B65H 2405/324; B65H 2407/21; B65H 2511/11; B65H 2511/12; B65H 2511/20; B65H 2513/40; B65H 2513/50; B65H 2551/212; B65H 2551/25; B65H 2551/26; B65H 2551/27; B65H 2601/272; B65H 2601/31; B41J 11/0095; B41J 13/0018; B41J 13/0054; B41J 13/103
See application file for complete search history.

(56) References Cited

U.S. PATENT DOCUMENTS 7,284,753 B2 10/2007 Kotani
2013/0140754 A1* 6/2013 Nishiyama ..... B41J 11/008 271/2
2015/0360893 A1* 12/2015 Kuwata ..... G03G 15/6529 399/397

FOREIGN PATENT DOCUMENTS

JP 2005-194020 A 7/2005
JP 2016-088693 A 5/2016

* cited by examiner

*Primary Examiner* — David H Bollinger
(74) *Attorney, Agent, or Firm* — Venable LLP

(57) ABSTRACT

An image forming apparatus includes a sheet supporting portion, a regulating portion, a feeding portion, an image forming unit, a sheet detection unit, and a control unit. The control unit is configured to execute, in a state where an image forming job in which an image is formed by the image forming unit is interrupted, a drive processing of the feeding portion such that (a) the feeding portion is driven at a first timing if the regulating portion is not set to a moved state within a predetermined period of time from when the sheet detection unit has detected the sheet, and (b) the feed portion is driven at a second timing later than the first timing if the regulating portion is set to the moved state within the predetermined period of time from when the sheet detection unit has detected the sheet.

11 Claims, 13 Drawing Sheets

(51) Int. Cl.

| | |
|---|---|
| ***B41J 13/10*** | (2006.01) |
| ***B41J 13/00*** | (2006.01) |
| ***B41J 11/00*** | (2006.01) |
| ***B65H 7/06*** | (2006.01) |

(52) U.S. Cl.
CPC .... *B65H 2405/324* (2013.01); *B65H 2407/21* (2013.01); *B65H 2511/11* (2013.01); *B65H 2511/12* (2013.01); *B65H 2511/20* (2013.01); *B65H 2513/40* (2013.01); *B65H 2513/50* (2013.01); *B65H 2551/212* (2013.01); *B65H 2551/25* (2013.01); *B65H 2551/26* (2013.01); *B65H 2551/27* (2013.01); *B65H 2601/272* (2013.01); *B65H 2601/31* (2013.01)

FIG.9A

| SHEET FEED TRAY | SHEET SIZE | SIZE X | SIZE Y | SHEET TYPE |
|---|---|---|---|---|
| MANUAL FEED TRAY | NOT SET | - | - | NOT SET |

FIG.9B

| | MODE | SHEET SIZE | SIZE X | SIZE Y | SHEET TYPE |
|---|---|---|---|---|---|
| DEFAULT SETTING OF MANUAL SHEET FEED | FIXED | FREE-SIZE | - | - | PLAIN PAPER |

FIG.9C

| | MODE | SHEET SIZE | SIZE X | SIZE Y | SHEET TYPE |
|---|---|---|---|---|---|
| DEFAULT SETTING OF MANUAL SHEET FEED | SET-PER-OPERATION | - | - | - | - |

FIG.9D

| | MODE | SHEET SIZE | SIZE X | SIZE Y | SHEET TYPE |
|---|---|---|---|---|---|
| DEFAULT SETTING OF MANUAL SHEET FEED | FIXED | A4 | - | - | RECYCLED PAPER |

FIG.9E

| JOB ID | SHEET FEED TRAY | SHEET SIZE | SIZE X | SIZE Y | SHEET TYPE |
|---|---|---|---|---|---|
| 00001 | MANUAL FEED TRAY | FREE-SIZE | 297mm | - | PLAIN PAPER |
| 00002 | UPPER TRAY | A4 | - | - | PLAIN PAPER |
| 00003 | - | - | - | - | - |

IMAGE FORMING APPARATUS, METHOD FOR CONTROLLING IMAGE FORMING APPARATUS, AND NON-TRANSITORY COMPUTER READABLE MEDIUM

BACKGROUND OF THE INVENTION

Field of the Invention

The present invention relates to an image forming apparatus for forming images on sheets, a method for controlling the image forming apparatus, and a non-transitory computer readable medium storing a program for executing the method for controlling the image forming apparatus using a computer.

Description of the Related Art

In general, image forming apparatuses such as copying machines, printers and facsimiles have a manual feed tray on which sheets serving as recording materials are supported, and the image forming apparatuses form images on sheets fed from the manual feed tray. Hitherto, a facsimile device configured to set a size of the sheet supported on a manual feed tray in advance through a control portion is proposed (refer to Japanese Patent Laid-Open Publication No. 2005-194020). According to this facsimile device, if the size of the sheet is not set through the control portion, the size of the sheet is determined by a size sensor provided on a sheet conveyance path.

It is common to arrange side regulating plates that are movable in a width direction orthogonal to a sheet conveyance direction and that are configured to regulate edge positions of the sheet in the width direction on the manual feed tray. The sheet supported on the manual feed tray having the width-direction positions regulated by the side regulating plate is conveyed in a non-skewed manner.

However, according to the facsimile device disclosed in the above-mentioned Japanese Patent Laid-Open Publication No. 2005-194020, the sheet is fed if an image forming job is entered, regardless of whether the sheet size is set in advance through the operation unit. Therefore, the sheet may be fed before the positions of the side regulating plates are adjusted by a user, and the width-direction positions of the sheet may not be regulated sufficiently by the side regulating plate, such that the sheet may be skewed during feeding.

Especially in a state where there are no more sheets on the tray during an image forming job forming images continuously on multiple sheets and the image forming job is interrupted, the image forming job may be resumed automatically when the user supplies sheets. In that case, there is not enough time for the user to adjust the positions of the side regulating plates, and the sheet may be fed while the user is still adjusting the positions of the side regulating plates. This may lead to drawbacks such as printing failure and sheet conveyance failure.

SUMMARY OF THE INVENTION

According to a first aspect of the present invention, an image forming apparatus includes a sheet supporting portion on which a sheet is supported, a regulating portion configured to be movable with respect to the sheet supporting portion, and regulate a position of the sheet supported on the sheet supporting portion, a feeding portion configured to feed the sheet supported on the sheet supporting portion, an image forming unit configured to form an image on the sheet fed from the sheet supporting portion, a sheet detection unit configured to detect that a sheet is supported on the sheet supporting portion, and a control unit configured to execute, in a state where an image forming job in which an image is formed by the image forming unit is interrupted, a drive processing of the feeding portion such that (a) the feeding portion is driven at a first timing if the regulating portion is not set to a moved state within a predetermined period of time from when the sheet detection unit has detected the sheet, and (b) the feed portion is driven at a second timing later than the first timing if the regulating portion is set to the moved state within the predetermined period of time from when the sheet detection unit has detected the sheet.

According to a second aspect of the present invention, a method for controlling an image forming apparatus configured to regulate a position of a sheet supported on a sheet supporting portion by a regulating portion, the method includes acquiring information, by a control unit, indicating that an image forming job in which an image forming unit is caused to form an image is in an interrupted state, determining, by a control unit, whether a regulating portion has been set to a moved state at least after a sheet detection unit detects that a sheet is supported on the sheet supporting portion, and driving, by a control unit, a sheet feeding portion configured to feed the sheet supported on the sheet supporting portion at a first timing if the control unit determines that the moved state is not detected within a predetermined period of time, and at a second timing that is later than the first timing if the control unit determines that the moved state has been detected within the predetermined period of time.

According to a third aspect of the present invention, a non-transitory computer readable medium storing a program code configured to control an image forming apparatus that is configured to regulate a position of a sheet supported on a sheet supporting portion by a regulating portion, the program code includes acquiring information, by a control unit, indicating that an image forming job in which an image forming unit is caused to form an image is in an interrupted state by a control unit, determining, by a control unit, whether a regulating portion has been set to a moved state at least after a sheet detection unit detects that a sheet is supported on the sheet supporting portion, and driving, by the control unit, a sheet feeding portion configured to feed the sheet supported on the sheet supporting portion at a first timing if the control unit determines that the moved state is not detected within a predetermined period of time, and at a second timing that is later than the first timing if the control unit determines that the moved state has been detected within the predetermined period of time.

Further features of the present invention will become apparent from the following description of exemplary embodiments with reference to the attached drawings.

BRIEF DESCRIPTION OF THE DRAWINGS

FIG. 9A is a table illustrating an example of a determined sheet size information stored in a memory.

FIG. 9B is a table illustrating an example of information regarding a default setting stored in the memory.

FIG. 9C is a table illustrating an example of information regarding the default setting stored in the memory.

FIG. 9D is a table illustrating an example of information regarding the default setting stored in the memory.

FIG. 9E is a table illustrating an example of job identifier and determined sheet size information according to a second embodiment.

DESCRIPTION OF THE EMBODIMENTS

First Embodiment

Now, preferred embodiments of the present invention will be described in detail with reference to the drawings. The embodiments described hereafter are not intended to limit the scope of the invention in any way, and not all the combinations of characteristics illustrated in the embodiments are necessary to implement the present invention.

Figure 1:
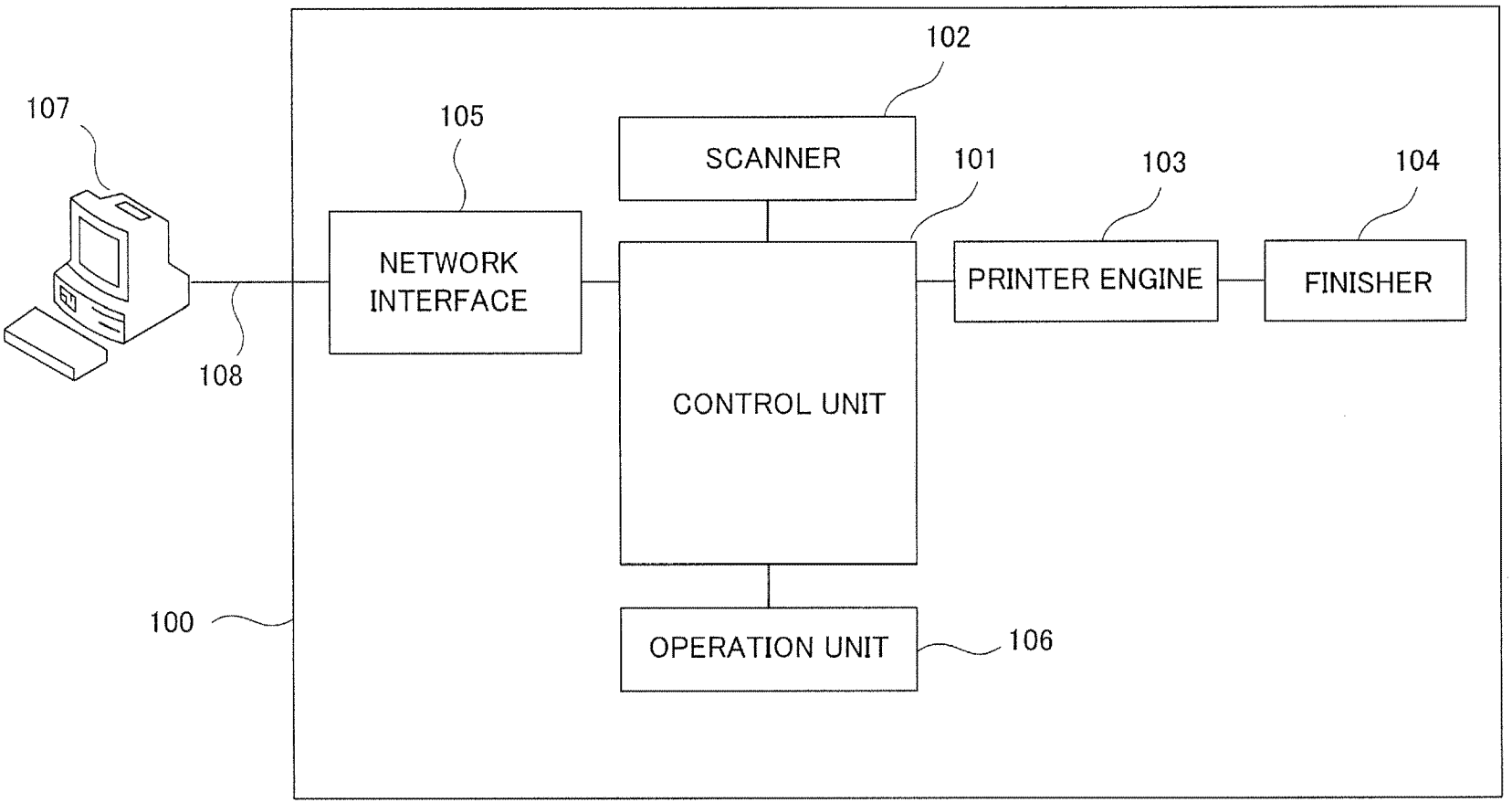
FIG. 1 is a view illustrating a general configuration of a system including an image forming apparatus according to a present embodiment.
Figure 2:
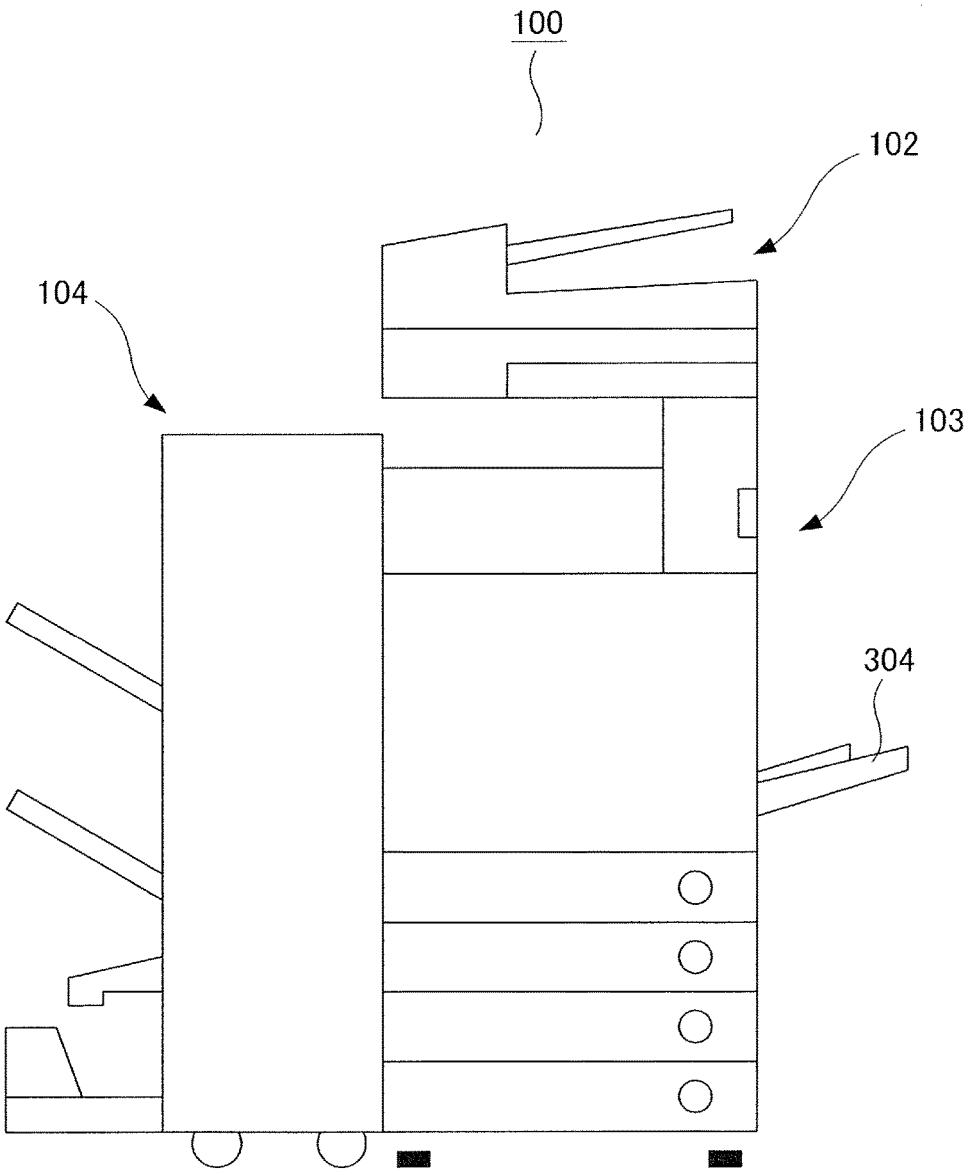
FIG. 2 is a front view illustrating the image forming apparatus.
Figure 3:
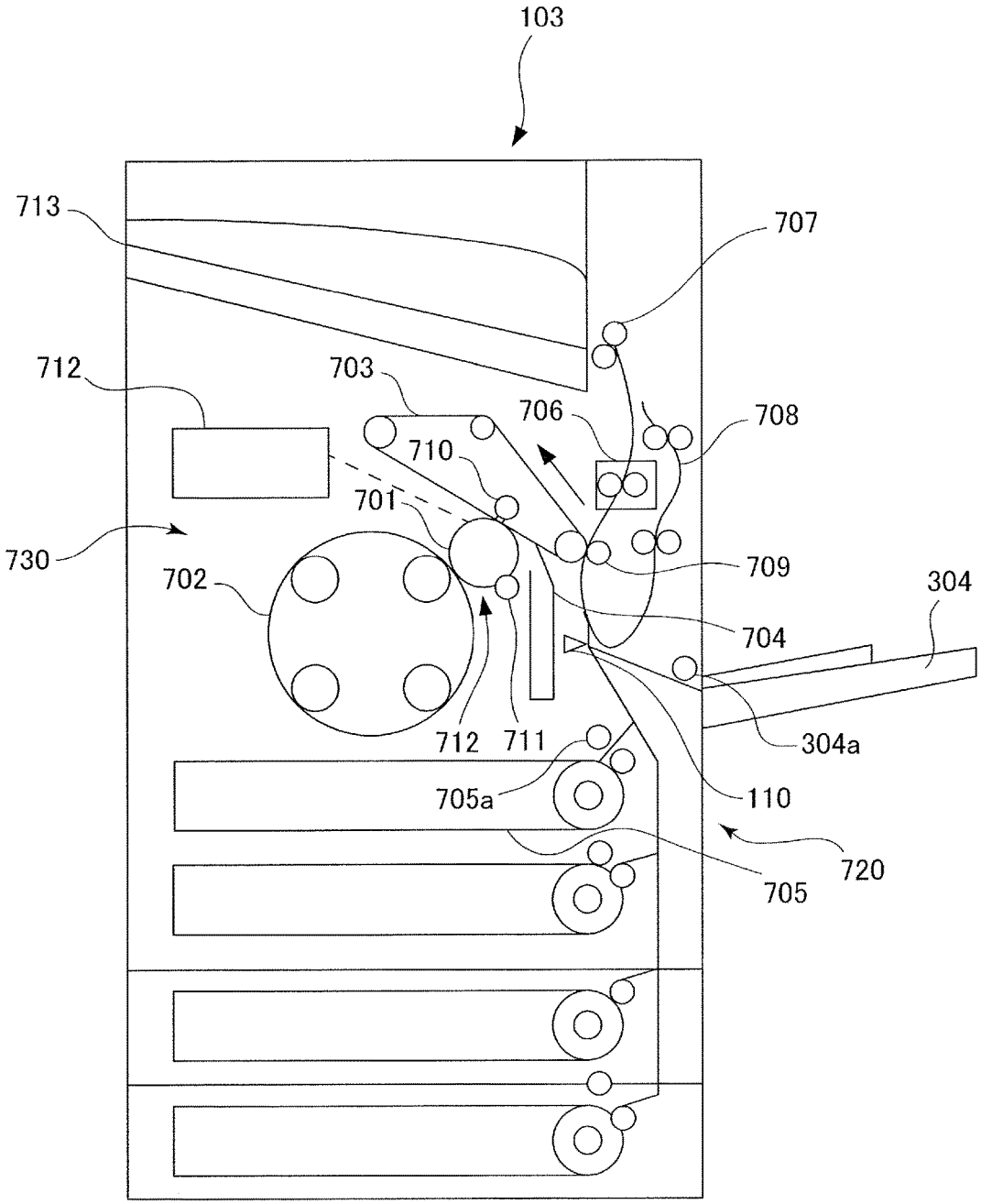
FIG. 3 is a schematic diagram illustrating a printer engine.

FIG. 1 is a view illustrating a general configuration of a system including an image forming apparatus 100 according to the present embodiment. The image forming apparatus 100 described later with reference to FIGS. 2 and 3 is controlled by a control unit 101, and the control unit 101 is enabled to perform mutual communication with a computer 107 through a network 108 using a network interface 105.

A scanner 102, a printer engine 103 and an operation unit 106 are connected to the control unit 101. The scanner 102 reads an image on a document, and outputs image data corresponding to the image. The printer engine 103 is a laser beam printer engine according to the present embodiment, and it forms an image on a sheet based on image data from the scanner 102 or output from a computer 107. The operation unit 106 includes a display portion having a touch panel function and various hard keys, and an image or a message can be displayed on the display portion based on information from the control unit 101. A finisher 104 configured to subject the sheets discharged from the printer engine 103 to postprocessing such as stapling and bookbinding is connected to the printer engine 103, and the finisher 104 is also controlled by the control unit 101.

Hardware Configuration of Image Forming Apparatus

Next, a hardware configuration of the image forming apparatus 100 will be described. FIG. 2 is a front view illustrating the image forming apparatus 100. FIG. 3 is a schematic diagram illustrating the printer engine 103. The image forming apparatus 100 includes, as illustrated in FIG. 2, the printer engine 103, the scanner 102 connected above the printer engine 103, and the finisher 104 connected to a side of the printer engine 103. The scanner 102 illuminates the image on the document being fed, scans the document using a CCD line sensor, converts the image of the document into electric image data, and subjects the image data to document color determination, sheet size determination and so on. A sheet refers to, in addition to plain paper, special paper such as coated paper, recording material having a special shape such as an envelope or an index paper, plastic films such as OHP sheets, and cloth.

The printer engine 103 is a full color laser beam printer, and as illustrated in FIG. 3, includes a sheet feeding portion 720 configured to feed sheets, an image forming unit 730 configured to form images on the sheet fed from the sheet feeding portion 720, and a fixing unit 706. The image forming unit 730 includes an exposing unit 712, a photosensitive drum 701, a charging unit 711, a cleaning unit 704, a developing apparatus 702, an intermediate transfer belt 703, a primary transfer roller 710, and a secondary transfer roller 709.

In a state where an image forming process by the image forming unit 730 is started, a surface of the photosensitive drum 701 is charged uniformly by a charging unit 711. Then, the exposing unit 712 irradiates laser beams to the photosensitive drum 701 based on image signals from the control unit 101, and an electrostatic latent image corresponding to a first color component is formed on a surface of the photosensitive drum 701. The electrostatic latent image is developed by one developing unit within the developing apparatus 702, and a toner image of a first color component is formed. A toner image of the first color component is transferred by the primary transfer roller 710 to the intermediate transfer belt 703. The toner remaining on the photosensitive drum 701 after the toner image has been transferred to the intermediate transfer belt 703 is collected by the cleaning unit 704. The image forming unit 730 performs such transfer processing repeatedly, until four color images are superposed on the intermediate transfer belt 703 and a color image is formed. If a single color image is to be formed, transfer processing is only performed once.

The sheet feeding portion 720 includes a plural number of (four according to the present embodiment) cassettes 705, a manual feed tray 304 serving as a sheet supporting portion, and pickup rollers 304*a* and 705*a* serving as feed portions configured to feed sheets. A sheet length sensor 110 is arranged at a merging portion where a conveyance path through which the sheet fed by the pickup roller 304*a* and a conveyance path through which the sheet fed by the pickup roller 705*a* meet. The sheet length sensor 110 detects the length of the sheet being conveyed if the determined sheet size information is set to free size described later. In parallel with the image forming process, the sheet is fed from one of the cassettes 705 or the manual feed tray 304 via the pickup roller 304*a* or 705*a*. The color image formed on the intermediate transfer belt 703 is transferred by the secondary transfer roller 709 to the sheet fed by sheet feeding portion 720. The sheet onto which the color image is transferred is subjected to heat and pressure at the fixing unit 706, by which the color image is fixed to the sheet. The sheet having passed through the fixing unit 706 is discharged by a sheet discharge roller pair 707 onto a sheet discharge tray 713.

If duplex printing is to be performed, the sheet onto which an image is formed on a first side is subjected to switch-back by the sheet discharge roller pair 707 and guided to a duplex conveyance path 708. Then, after an image is formed on a second side by the image forming unit 730, the sheet is discharged by the sheet discharge roller pair 707 onto the sheet discharge tray 713. The sheet can also be discharged onto the finisher 104 instead of on the sheet discharge tray 713.

Figure 4:
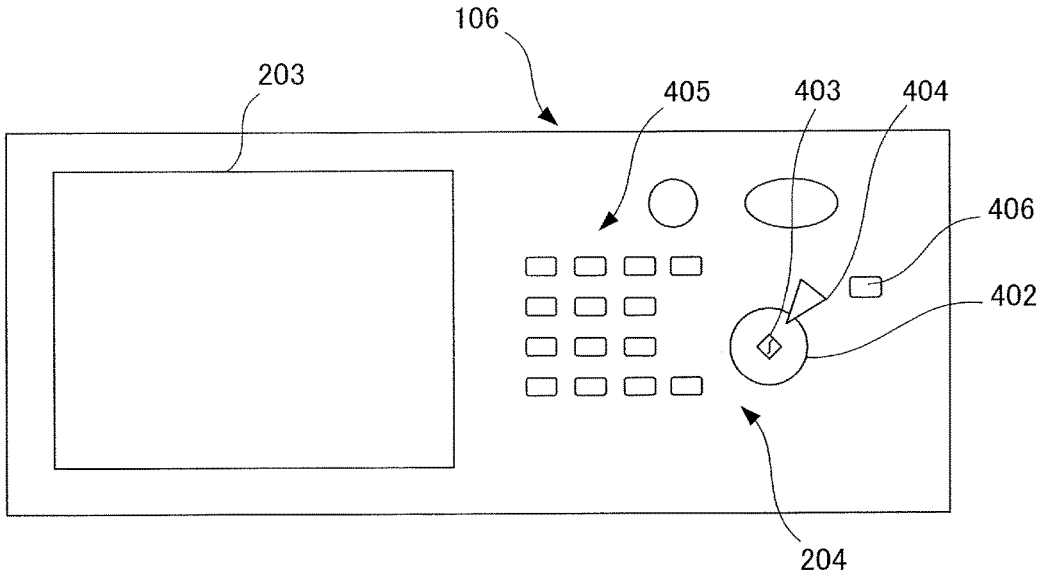
FIG. 4 is a schematic diagram illustrating an operation unit provided on the image forming apparatus.

FIG. 4 is a schematic diagram illustrating the operation unit 106 provided on the image forming apparatus 100. As illustrated in FIG. 4, the operation unit 106 includes a display portion 203 and a keyboard 204, wherein the display portion 203 includes a liquid crystal panel configured to display an image, and a touch panel sheet adhered to the liquid crystal panel. Therefore, the display portion 203 notifies various information through images to users, and allows the users to enter various settings through the touch panel.

The keyboard 204 includes a start key 402, a stop key 404, a numeric key 405 and a user mode key 406. The start key 402 is used for example when starting an operation to read the document image, and LEDs 403 composed of two colors, green and red, are disposed at the center portion of the start key 402. If the LED 403 is lit in green, it indicates that the start key 402 is in a usable state, and if the LED 403 is lit in red, it indicates that the start key 402 is in a non-usable state. If the stop key 404 is pressed, the control unit 101 stops operation of an ongoing job, such as feeding of a sheet or writing of an image. The numeric key 405 is composed of a group of buttons of numbers and letters, and it is used for setting the number of copies, entering facsimile numbers and so on. The user mode key 406 is used for performing instrument setup and so on.

Figure 5C:
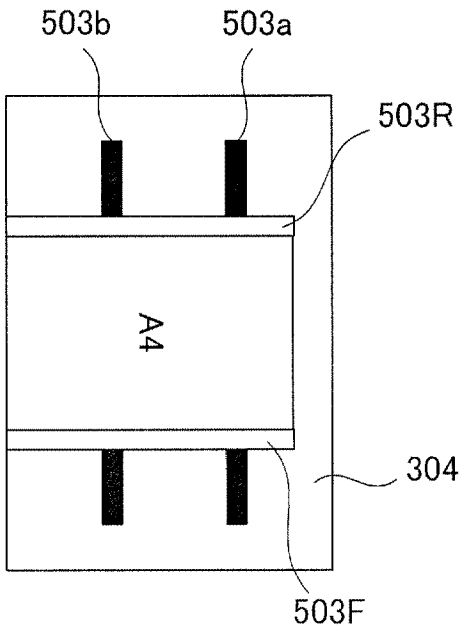
FIG. 5C is a plan view illustrating the manual feed tray in a state where an A4 sized sheet is placed in landscape orientation.
Figure 5B:
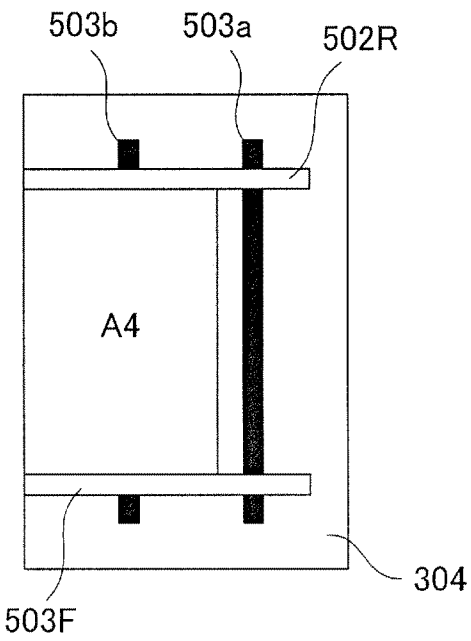
FIG. 5B is a plan view illustrating the manual feed tray in a state where an A4 sized sheet is placed in portrait orientation.
Figure 5A:
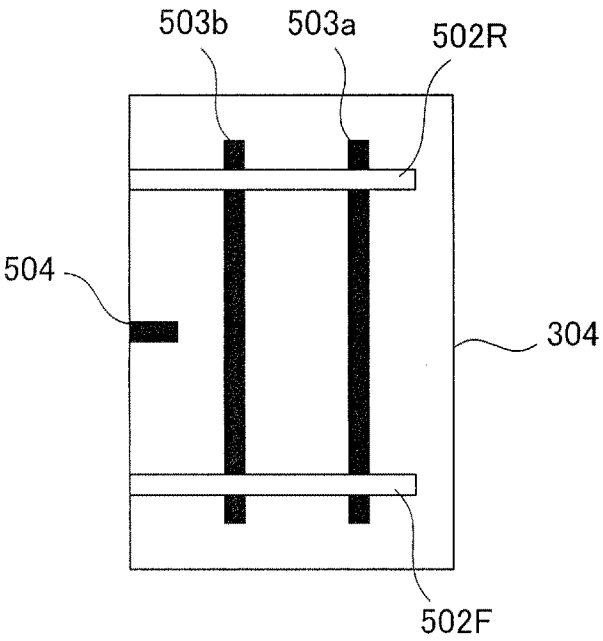
FIG. 5A is a plan view illustrating a manual feed tray in a state where no sheet is placed thereon.

FIGS. 5A through 5C are plan views illustrating the manual feed tray 304. FIG. 5A illustrates the manual feed tray 304 in a state where a sheet is not placed thereon, and FIG. 5B illustrates the manual feed tray 304 in a state where an A4-sized sheet is arranged in portrait orientation. FIG. 5C illustrates the manual feed tray 304 in a state where an A4-sized sheet is arranged thereon in landscape orientation. The manual feed tray 304 is supported in an openable and closable manner on a side wall of the printer engine 103 (refer to FIG. 2), and as illustrated in FIG. 5A, two rails 503*a* and 503*b* extending in a width direction orthogonal to a sheet feeding direction are provided on the tray. Guide plates 502F and 502R serving as a pair of regulating portions are supported movably in a width direction on the rails 503*a* and 503*b*, and the guide plates 502F and 502R are configured such that if one of the guide plates is moved, the other guide plate is moved in an interlocked manner. The guide plates 502F and 502R are configured to regulate positions of edge portions in the width direction of the sheet.

Further, a sheet presence sensor 504 serving as a sheet detection unit is provided on the manual feed tray 304, and the sheet presence sensor 504 is configured to detect that a sheet has been placed on the manual feed tray 304. The sheet presence sensor 504 is composed, for example, of a flag member that moves if pressed by the sheet placed on the tray, and an optical sensor that outputs a detection signal if an optical path is blocked by the flag member.

As illustrated in FIG. 5B, if a sheet is supported on the manual feed tray 304, the user moves the guide plates 502F and 502R in correspondence to edge portions of the sheet in the width direction. Thereby, edge positions of the sheet in the width direction are regulated, and the sheet is fed by the pickup roller 604*a* in a less skewed manner. A guide width sensor 109 (refer to FIG. 6) for detecting the position of the guide plates 502F and 502R is provided on the manual feed tray 304, and based on a detection result of the guide width sensor 109, the control unit 101 determines the size of the sheet supported on the manual feed tray 304. Therefore, the control unit 101 can distinguish an A4 size sheet arranged in portrait orientation, as illustrated in FIG. 5B, from an A4 size sheet arranged in landscape orientation as illustrated in FIG. 5C.

Control Unit

Figure 6:
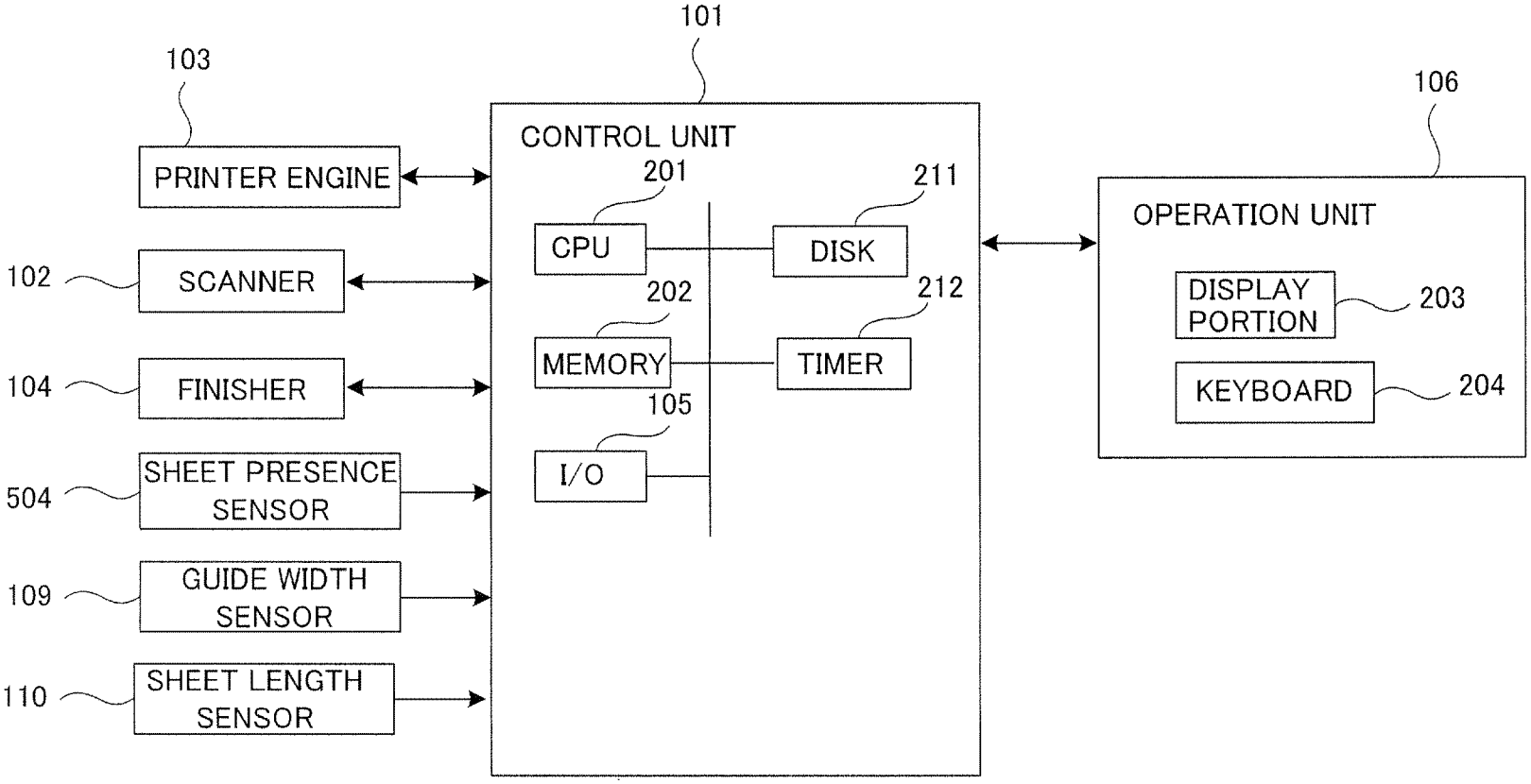
FIG. 6 is a block diagram illustrating a control block according to the present embodiment.

FIG. 6 is a block diagram illustrating a control block diagram of a present embodiment. The control unit 101 is composed of a control circuit including a CPU 201 serving as a central processing unit, a memory 202, a disk 211, a timer 212 and a network interface 105. The various programs executable by the CPU 201 and data are stored in the disk 211, such as a hard disk or a floppy disk, wherein the programs are sequentially read in the memory 202 as needed and executed by the CPU 201. The memory 202 can store various information. The disk 211 can be removably attached to the image forming apparatus 100 or built into the image forming apparatus 100. Further, the various programs can be downloaded from other image forming apparatuses or computers and stored in the disk 211. Moreover, the memory 202 can be equipped with both functions of a nonvolatile memory such as a DRAM and a volatile memory such as an SRAM, or as another example, the function of a volatile memory can be realized by the memory 202 and the function of a nonvolatile memory can be realized by the disk 211. Further, the memory 202 can be a removable memory medium.

The printer engine 103, the scanner 102, the finisher 104, the sheet presence sensor 504, the guide width sensor 109 serving as the position detection unit, the sheet length sensor 110 and the operation unit 106 are electrically connected to the control unit 101. The CPU 201 outputs data to the display portion 203 to have an image displayed on the display portion 203, and the CPU 201 can also receive instructions from the user through the display portion 203 equipped with a touch panel function or the keyboard 204. The information entered from the operation unit 106 is transferred to and stored in the memory 202 or the disk 211 and used for various processes.

By reading data from and writing data to the printer engine 103, the scanner 102 and the finisher 104, the CPU 201 controls the operations of these devices and acquires various statuses. The image data acquired from the scanner 102 or the network interface 105 is stored in the memory 202 or the disk 211. Further, by storing image data in advance in a removable memory 202 and connecting the memory to the control unit 101, the image data in the memory can be read. The image data stored in the disk 211 can be moved or copied to the memory 202, and based on the contents of the instruction from the operation unit 106, various additional images, such as numeric values of page numbers, can be added to image data in the memory 202.

The scanner 102, the printer engine 103 and the finisher 104 are not a part of the image forming apparatus 100, and they can be respective peripheral devices connected to the network and controlled by the control unit 101 of the image forming apparatus 100. The image forming apparatus 100 is not necessarily equipped with the scanner 102 and the finisher 104, and the printer engine 103 can be an inkjet printer where ink is discharged from a nozzle to form images on sheets, instead of the printer adopting an electrophotographic system.

The CPU 201 is one example of a control unit configured to execute an image forming job and causing the printer engine 103 to perform the image forming operation. An image forming job is an image forming operation task that the control unit 101 executes, and specifically, it refers to a data string including image data of respective pages, and function settings such as the number of copies, sheet size and sheet type, whether to perform duplex printing, stapling and so on. The image forming job includes a copy job generated by the control unit 101 based on image data acquired by the scanner 102 and a job where image data is entered from the external computer 107 (refer to FIG. 1) or the like.

In the following description, information subjected to rewrite is described as being stored in the memory 202 serving as an example of a storage portion, but the information can also be stored in the disk 211 or an external computer and the like.

Setting of Sheet Information

Figure 7B:
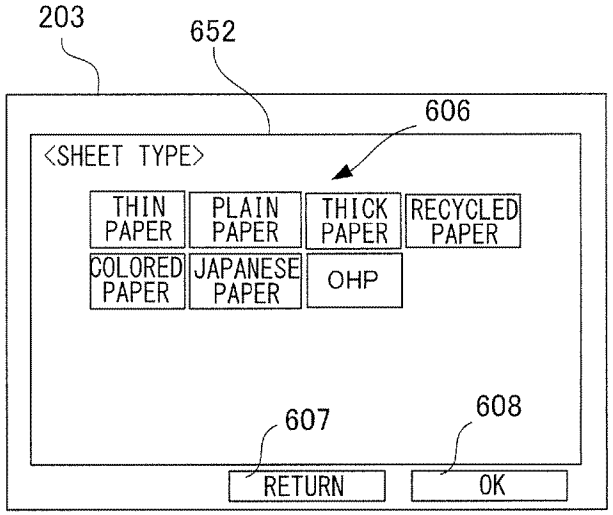
FIG. 7B is a view illustrating a display portion on which a sheet type setting screen is displayed.
Figure 7A:
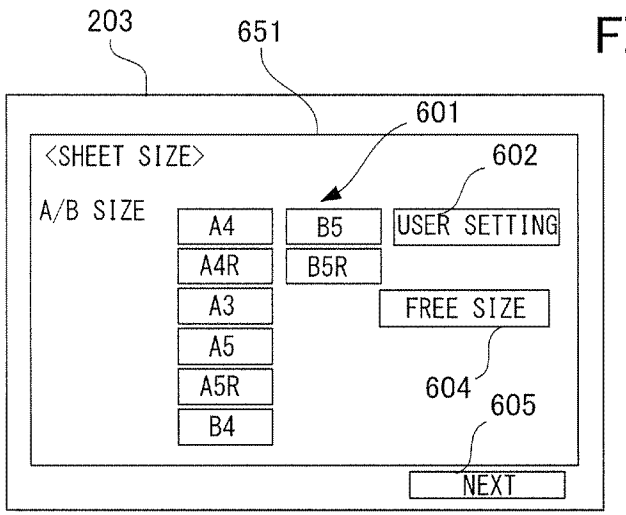
FIG. 7A is a view illustrating a display portion on which a size setting screen is displayed.
Figure 7C:
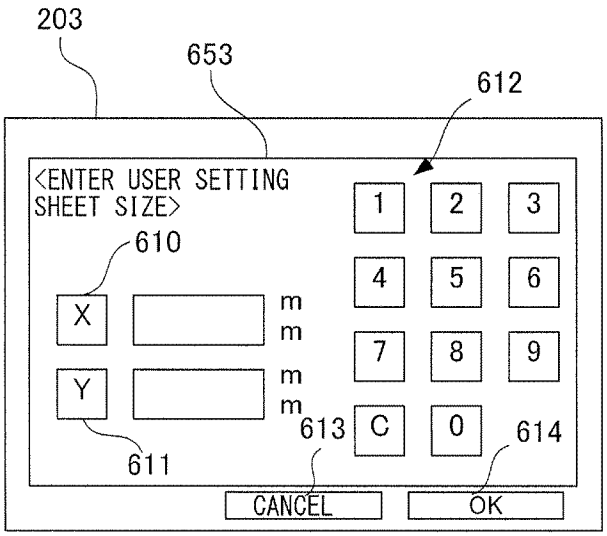
FIG. 7C is a view illustrating a display portion on which a user setting screen is displayed.

Next, the method of setting sheet information in the image forming apparatus 100 will be described. FIG. 7A is a view illustrating the display portion 203 on which a sheet size setting screen 651 is displayed, FIG. 7B is a view illustrating the display portion 203 on which a sheet type setting screen 652 is displayed, and FIG. 7C is a view illustrating the display portion 203 on which a user setting screen 653 is displayed. Various buttons are displayed as image on the display portion 203, and in the following description, the selection of a button by the user is referred to as pressing a button, similar to the case of a physical button. Of course, it is possible to use a physical button instead of a button displayed on the touch panel of the display portion 203.

If the sheet presence sensor 504 detects that a sheet has been placed on the manual feed tray 304 in a state where a set-per-operation mode described later is selected, the sheet size setting screen 651 is displayed on the display portion 203, as illustrated in FIG. 7A. The sheet size setting screen 651 includes a regular size button group 601, a user setting button 602, a free size button 604, and a next button 605. The regular size button group 601 is a group of buttons used for setting up regular sheet sizes.

The user setting button 602 is pressed if the user wishes to set an arbitrary sheet size. If the user presses the user setting button 602, as illustrated in FIG. 7C, the user setting screen 653 is displayed on the display portion 203. The user setting screen 653 includes an X button 610, a Y button 611, a numeric button group 612, a cancel button 613, and an OK button 614. The X button 610 is pressed in a state where the user sets a length of the sheet in a crosswise direction of the sheet, that is, in a width direction, and the Y button 611 is pressed in a state where the user sets a length of the sheet in a longitudinal direction of the sheet, that is, in a sheet conveyance direction. The actual lengths of the sheet in the lateral and longitudinal directions are designated by the user through use of the numeric button group 612. The cancel button 613 is pressed in a state where the user wishes to discontinue the size setting using the user setting screen 653, and if the cancel button 613 is pressed, the sheet size setting screen 651 is displayed again on the display portion 203.

If the OK button 614 is pressed on the user setting screen 653 or if the next button 605 is pressed on the sheet size setting screen 651, the sheet size being set is stored as selected sheet size information in the memory 202. If the selected sheet size information is stored in the memory 202, the CPU 201 detects the positions of the guide plates 502F and 502R in the width direction by the guide width sensor 109. Hereafter, the distance between the guide plates 502F and 502R is referred to as guide width, and the guide width sensor 109 is configured to detect the guide width. The CPU 201 executes a check processing of checking whether the guide width detected by the guide width sensor 109 and the selected sheet size information stored in the memory 202 correspond. If the guide width differs greatly from the selected sheet size information stored in the memory 202, the CPU 201 outputs a warning to the user. The warning can be performed, for example, by displaying an error screen on the display portion 203, outputting a warning sound, or combining these methods. Thereby, the user is prompted to perform setting of the determined sheet size information again.

If the sheet size and the guide width do not differ greatly, as illustrated in FIG. 7B, the sheet type setting screen 652 is displayed on the display portion 203. The sheet type setting screen 652 includes a sheet type setting button group 606, a return button 607, and an OK button 608. If one of the buttons of the sheet type setting button group 606 corresponding to the various sheet types is pressed, the corresponding sheet type is stored as selected sheet type information in the memory 202. The return button 607 is pressed if the user wishes to discontinue setting using the sheet type setting screen 652, and if the return button 607 is pressed, the sheet size setting screen 651 is displayed on the display portion 203. If the OK button 608 is pressed, the selected sheet size information and the selected sheet type information are stored as determined sheet size information and determined sheet type information in the memory 202. The determined sheet size information is a first information related to the sheet size associated with the manual feed tray 304.

The free size button 604 illustrated in FIG. 7A is a button for selecting an irregular size where the user does not designate the longitudinal and lateral lengths of the sheet size. If the next button 605 is pressed in a state where the free size button 604 is selected, a third information indicating that an omitted setting in which the input of determined sheet size information as the first information can be omitted is effective is stored in the memory 202. If a free size is stored as the selected sheet size information in the memory 202, the above-described check processing of the selected sheet size information and the guide width is not executed. The sheet size is detected after the sheet has been fed by a sheet length detection sensor 110 arranged on the conveyance path (refer to FIG. 3), and based on the detection result, an image is formed on the sheet. The free size setting is cancelled if a button of the regular size button group 601 or the user setting button 602 is pressed.

Default Setting

Figure 8B:
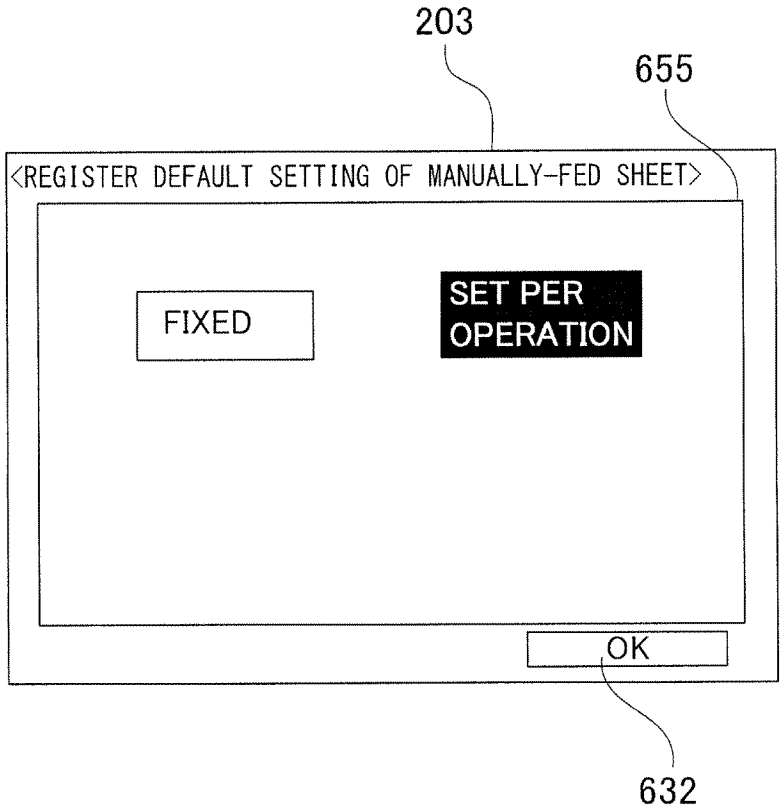
FIG. 8B is a view illustrating the default setting screen on which a set-per-operation mode is selected.
Figure 8A:
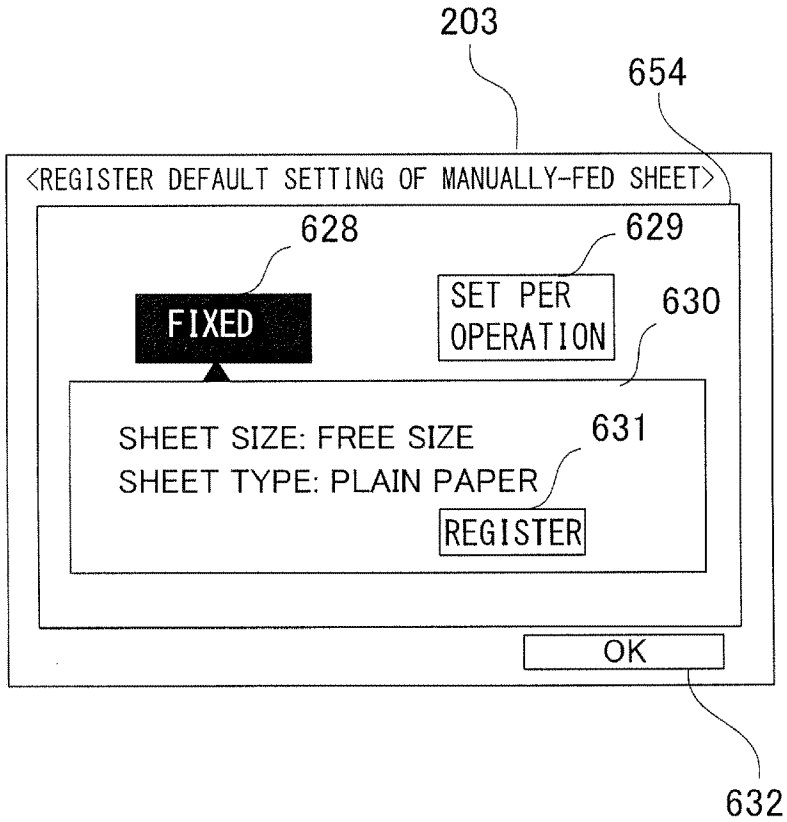
FIG. 8A is a view illustrating a default setting screen on which a fixed mode is selected.

Next, we will describe a method for registering a default setting of the sheet used in the manual feed tray 304. FIG. 8A illustrates a default setting screen 654 in a state where a fixed mode is selected, and FIG. 8B is a view illustrating a default setting screen 655 in a state where a set-per-operation mode is selected. The default setting screens 654 and 655 are displayed if the user operates a setting button on the operation unit 106.

If the user selects the fixed mode, the user presses a fixed button 628 as illustrated in FIG. 8A, and if the user selects the set-per-operation mode, the user presses a set-per-operation button 629. If an OK button 632 is pressed in a state where the fixed button 628 is selected, the fixed mode is stored as default setting in the memory 202. If the OK button 632 is pressed in a state where the set-per-operation button 629 is selected, the set-per-operation mode is stored as default setting in the memory 202. That is, if the OK button 632 is pressed, a second information indicating whether the set-per-operation mode or the fixed mode is selected as manual setting mode is stored in the memory 202.

In a state where the fixed mode is set, even if the user places a sheet on the manual feed tray 304 and the sheet is detected by the sheet presence sensor 504, the sheet size setting screen 651 illustrated in FIG. 7A is not displayed on the display portion 203. Then, the sheet size and the sheet type displayed on a sheet information display area 630 illustrated in FIG. 8A are automatically stored as selected sheet size information and selected sheet type information in the memory 202. In order to change the information on the sheet information display area 630, the user presses a register button 631. Then, the sheet size setting screen 651 illustrated in FIG. 7A is displayed on the display portion 203 and setting of the size information and the type information is performed by following the above-described procedure.

FIG. 9A illustrates one example of the sheet size serving as determined sheet size information and the sheet type serving as determined sheet type information stored in the memory 202, and FIG. 9A corresponds to a state where no sheet is placed on the manual feed tray 304. FIGS. 9B through 9D illustrate information related to the default setting stored in the memory 202. As illustrated in FIG. 8A, if a fixed mode is selected as the default setting, the sheet size is set to free size, and the sheet type is set to plain paper, the information related to default setting will be as illustrated in FIG. 9B. Further, as illustrated in FIG. 8B, if a set-per-operation mode is selected as the default setting, the information regarding the default setting will be as illustrated in FIG. 9C. If the fixed mode is selected as the default setting, A4 size is selected as the sheet size and recycled paper is set as the sheet type, the information regarding the default setting will be as illustrated in FIG. 9D.

Setting of Manually-Fed Sheet Information

Figure 10:
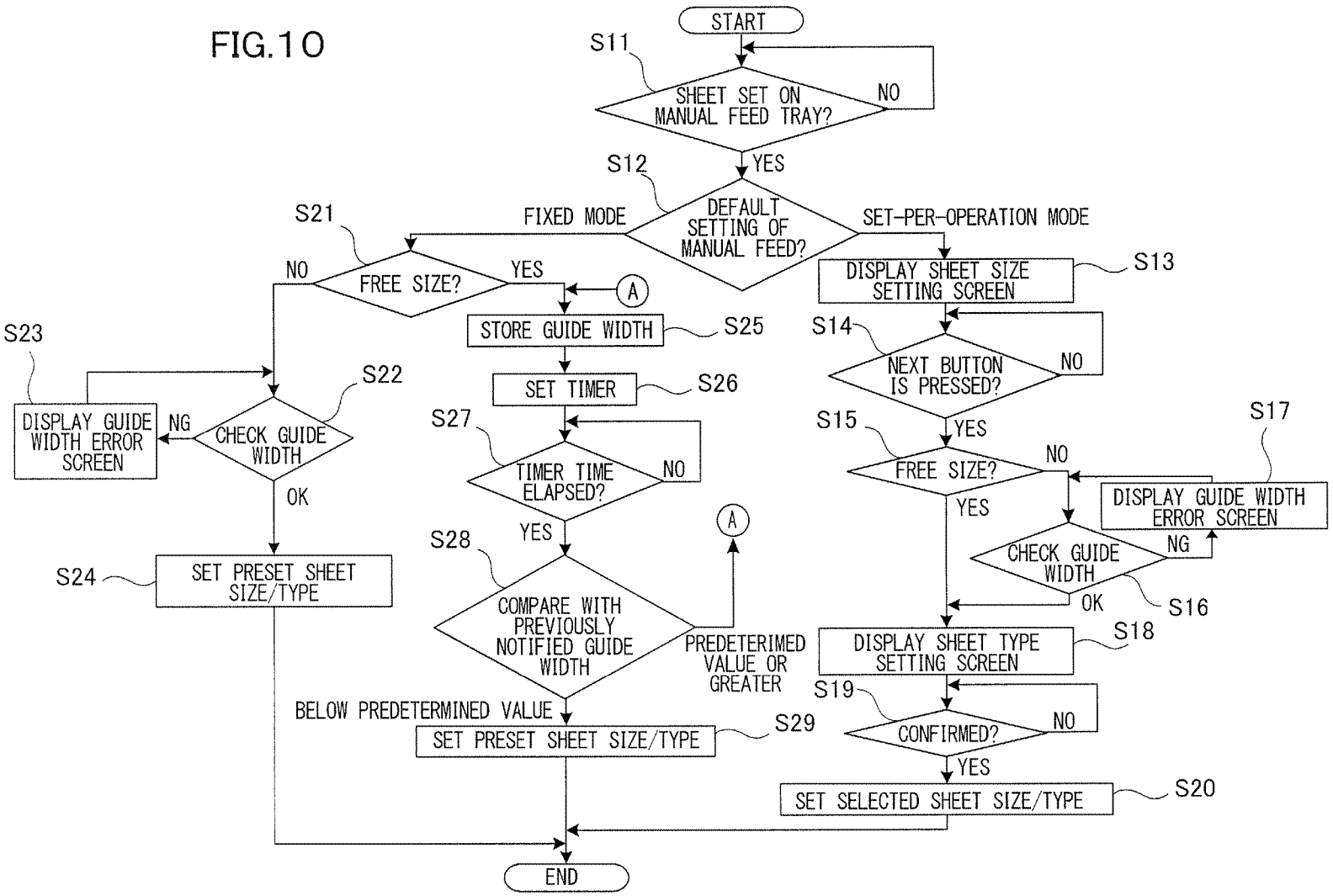
FIG. 10 is a flowchart illustrating a setting processing of a manually-fed sheet information.

Next, a processing of setting information regarding the sheet supported on the manual feed tray 304 (hereafter referred to as manually-fed sheet information) is described with reference to a flowchart illustrated in FIG. 10. A program for executing the setting processing is installed in the disk 211, expanded in the memory 202 during execution and executed under the control of the CPU 201.

At first, the CPU 201 determines whether a sheet is supported on the manual feed tray 304 based on the detection result of the sheet presence sensor 504 (step S11). If it is determined that a sheet is placed (step S11: YES), the CPU 201 confirms the default setting of the manual feed tray 304 stored in the memory 202 (step S12). If the default setting is a set-per-operation mode (step S12: set-per-operation mode, illustrated for example in FIG. 9C), the CPU 201 causes the display portion 203 to display the sheet size setting screen 651 (step S13). If the next button 605 is pressed on the sheet size setting screen 651 (step S14: YES), the CPU 201 determines whether the selected sheet size information is a free size (step S15). If the selected sheet size information is not a free size (step S15: NO), the CPU 201 performs a check processing on whether the selected sheet size information and the guide width detected by the guide width sensor 109 correspond (step S16).

In the check processing, if the selected sheet size information and the guide width differ greatly (step S16: NG), the CPU 201 causes the display portion 203 to display a guide width error screen prompting the user to reset the selected sheet size information (step S17). In the present embodiment, if the difference between sheet width in the selected sheet size information and guide width is 10 mm or greater, the check processing is determined as NG, while if the difference is smaller than 10 mm, the check processing is determined as OK, but this threshold can be set arbitrarily. If the selected sheet size information and the guide width do not differ greatly in the check processing (step S16: OK), the CPU 201 causes the display portion 203 to display the sheet type setting screen 652. Then, if the user presses the OK button 608 (step S19: YES), the selected sheet size information and the selected sheet type information are respectively stored in the memory 202 as determined sheet size information and determined sheet type information, and the setting processing is ended.

Meanwhile, if the default setting of the manual feed tray 304 is a fixed mode (step S12), the CPU 201 determines whether the selected sheet size information is a free size (step S21). If it is determined that the selected sheet size information is not a free size (step S21: NO), the CPU 201 executes the above-described check processing (step S22). If the check processing is NG (step S22: NG), the CPU 201 causes the display portion 203 to display a guide width error screen prompting the user to reset the selected sheet size information, similar to step S17 (step S23).

If the check processing is OK (step S22: OK), the selected sheet size information and the selected sheet type information, that is, the information regarding the sheet information display area 630 (refer to FIG. 8A) are respectively stored as determined sheet size information and determined sheet type information in the memory 202.

Further, if it is determined in step S21 that the selected sheet size information is a free size (step S21: YES), the CPU 201 temporarily stores the guide width at that time in the memory 202 based on the detection result of the guide width sensor 109 (step S25). Then, the CPU 201 starts measuring time using the timer 212 (refer to FIG. 6) (step S26). In the present embodiment, sampling time measured by the timer 212 is set to 500 msec, but the sampling time can be varied arbitrarily.

Then, the CPU 201 determines whether a sampling time set in the timer 212 has elapsed (step S27), and if the sampling time has elapsed (step S27: YES), the procedure advances to step S28. In step S28, the CPU 201 executes a movement determination processing in which the guide width temporarily stored in the memory 202 in step S25 and the guide width at a point of time when the sampling time has elapsed are compared. If the difference between the guide widths is equal to or greater than a predetermined value, which is 5 mm in the present embodiment (step S28: equal to or greater than predetermined value), the procedure returns to step S25. If the difference between the guide widths is smaller than the predetermined value (step S28: below predetermined value), the CPU 201 stores the selected sheet size information and the selected sheet type information (for example, as illustrated in FIG. 9B) as determined sheet size information and determined sheet type information in the memory 202, and ends the setting processing. Therefore, in the example illustrated in FIG. 9B, the determined sheet size information is set to free size and the determined sheet type information is set to plain paper, which are stored in the memory 202.

Setting of Manually-Fed Sheet Information During Job Interruption

Next, setting processing of manually-fed sheet information during job interruption will be described with reference to the flowchart illustrated in FIG. 11. The image forming job is interrupted, for example, if there are no more sheets in midway of continuous printing operation, that is, if the sheet presence sensor 504 does not detect sheets, or if jamming of sheets has occurred. The program for executing the setting processing is installed in the disk 211, expanded in the memory 202 during execution and executed under the control of the CPU 201.

At first, an image forming job is executed in a state where the manual feed tray 304 is designated by the user (step S30), and the CPU 201 determines whether the image forming job has been interrupted (step S31). If it is determined that the image forming job is not interrupted (step S31: NO) and no sheets are set on the manual feed tray 304 (step S32: YES), the CPU 201 determines whether the image forming job is completed (step S43). If the image forming job is completed (step S43: YES), the process is ended. If the image forming job is not completed (step S43: NO), the procedure returns to step S31.

If it is determined that the image forming job is interrupted in step S31 (step S31: YES), the procedure advances to step S33. The present processing includes an interrupted state acquisition step in which information indicating that the image forming job by which the CPU 201 causes the image forming unit to form images is in an interrupted state. In the processing, steps S33 through S41 are similar to steps S12 through S20 illustrated in FIG. 10, and steps S44 through S47 are similar to steps S21 through S24 illustrated in FIG. 10, so that these steps will not be described here. Steps S48 through S52 are similar to steps S25 through S29 illustrated in FIG. 10, but the processing illustrated in steps S48 through S52 is the main portion of the present invention, such that they will be described once again.

That is, if the default setting is set to set-per-operation mode in step S33 or if the default setting is set to fixed mode and the sheet size is not set to free size in step S44, a check processing of step S37 or step S45 is executed. In the check processing, it is confirmed whether the selected sheet size information and the guide width corresponding to the detection result of the guide width sensor 109 correspond, such that there is no problem for the user to place the sheet on the manual feed tray 304 before adjusting the positions of the guide plates 502F and 502R. That is, if the selected sheet size information and the guide width of the guide plates 502F and 502R do not correspond, a guide width error screen (refer to steps S38 and S46) is displayed on the display portion 203. The image forming job will not be resumed until the selected sheet size information and the guide width of the guide plates 502F and 502R correspond.

However, if the default setting is set to fixed mode and the selected sheet size information is set to free size, the sheet width information does not exist in the selected sheet size information, and the above-described check processing is not performed. Some users adjust the position of the guide plates 502F and 502R after placing the sheet on the manual feed tray 304. Therefore, if the sheet is placed on the manual feed tray 304 during interruption of the image forming job, free size is immediately stored as the determined sheet size information in the memory 202 and the image forming job is resumed, such that the sheet may be skewed. This problem is caused by the user not having enough time to adjust the guide plates 502F and 502R, and the sheet is fed in a state where the guide plates 502F and 502R are distant from the sheet.

Meanwhile, for example, if the preset sheet size and sheet type are respectively stored as determined sheet size information and determined sheet type information in the memory 202 after a predetermined time has elapsed from placing the sheet on the manual feed tray 304, skewing of the sheet is reduced. However, the user must wait for a predetermined time before the image forming job is resumed even if the setting of the sheet on the manual feed tray 304 is completed, and the productivity is deteriorated. Therefore, the present invention aims at solving these problems.

Figure 11:
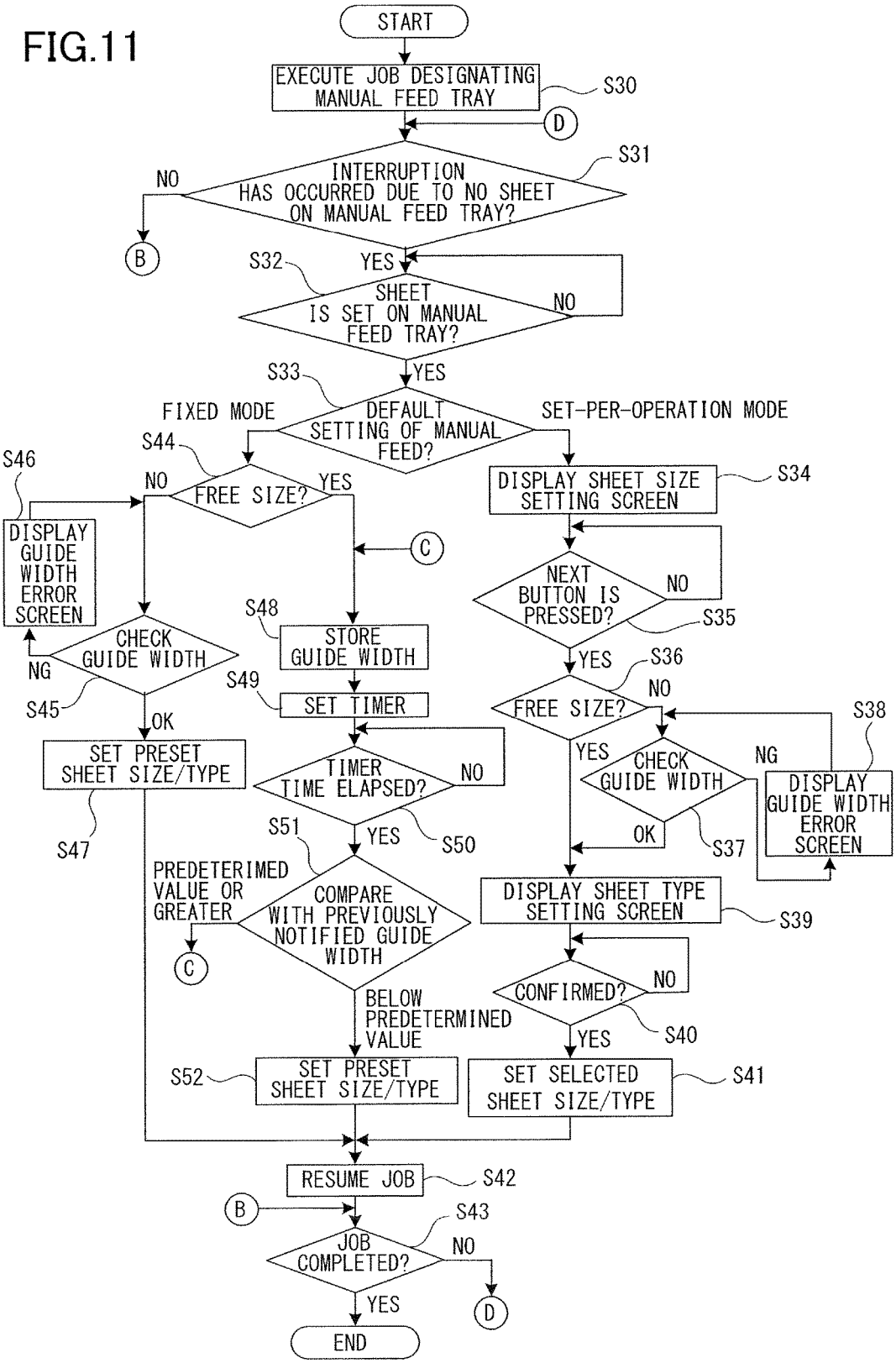
FIG. 11 is a flowchart illustrating a setting processing of a manually-fed sheet information during job interruption.

As illustrated in FIG. 11, we will assume a case where the fixed mode is selected as the default setting in step S33 (step S33: fixed mode) and free size is selected as the selected sheet size information in step S44 (step S44: YES). In this case, the mode is set to fixed mode, the third information indicates effectiveness of omitted setting (free mode), and the sheet presence sensor 504 detects presence of a sheet. The CPU 201 stores the guide width temporarily in the memory 202 based on the detection result of the guide width sensor 109 (step S48). The position of the guide plates 502F and 502R is the first position. The CPU 201 starts measurement of time based on the timer 212 (refer to FIG. 6) and enters a measurement start state (step S49).

The CPU 201 determines whether a sampling time set in the timer 212 has elapsed (step S50), and if the sampling time has elapsed (step S50: YES), the procedure advances to step S51. In step S51, the CPU 201 executes a movement determination processing in which the guide width temporarily stored in the memory 202 in step S48 and the guide width at the point of time where sampling time has elapsed are compared. The position of the guide plates 502F and 502R at the point of time where sampling time has elapsed is the second position. If the difference of these guide widths is greater than a preset value, 5 mm according to the present embodiment (step S51: greater than preset value), the procedure returns to step S48. This is because the procedure determines that the position of the guide plates 502F and 502R is being adjusted by the user. If the difference of guide width is smaller than the predetermined value (step S51: below predetermined value), the CPU 201 stores the selected sheet size information and the selected sheet type information (as illustrated in FIG. 9B, for example) as determined sheet size information and determined sheet type information in the memory 202. This is because the procedure determines that the adjustment of position of the guide plates 502F and 502R is completed by the user. Steps S48 through S51 are movement determination steps.

In the movement determination processing, the CPU 201 determines that the guide plates 502F and 502R are in the moved state if the difference between the guide widths is equal to or greater than a predetermined value, which is 5 mm in the present embodiment, and determines that the guide plates are in the stopped state if the difference between the guide widths is smaller than the predetermined value, which is 5 mm in the present embodiment. A predetermined value as threshold is set so as to prevent the CPU 201 from determining that the guide plates 502F and 502R are in the moved state even if the plates are slightly moved by vibration and the like.

If the guide plates 502F and 502R are in the moved state before elapse of a predetermined sampling time, the CPU 201 will not store the determined sheet size information and the determined sheet type information in the memory 202. Further, on the condition that the guide plates 502F and 502R are not in the moved state before the predetermined sampling time has elapsed, the CPU 201 stores the determined sheet size information and the determined sheet type information in the memory 202.

In steps S41, S47 and S52, if the determined sheet size information and the determined sheet type information are stored in the memory 202, the CPU 201 outputs an instruction to resume the image forming job (step S42). Thereby, for example, a drive processing in which the pickup roller 304*a* is driven is executed, and the sheet supported on the manual feed tray 304 is fed. Step S42 is a driving step. In step S43, if it is determined that the image forming job has been completed (step S43: YES), the procedure is ended.

As described, in a state where the image forming job is interrupted, if the default setting is set to fixed mode and the selected sheet size information is set to free size, the following processing is executed. If the guide plates 502F and 502R are not moved before a predetermined sampling time has elapsed, the determined sheet size information and the determined sheet type information are stored in the memory 202. Thereby, the image forming job is resumed and the sheet is fed. In this case, the timing in which the sheet is fed by the completion of the first measurement of sampling time is set as the first timing. The sheet is fed at the first timing if the CPU 201 determines that the guide plates 502F and 502R has never been set to the moved state.

If the guide plates 502F and 502R are in the moved state before a predetermined sampling time has elapsed, the timer 212 is reset, sampling time is measured again, and it is determined whether the plates are in a moved state. The timing in which the sheet is fed by the completion of a second or greater times of measurement of sampling time in the movement determination processing is set as a second timing that is later than the first timing. The case in which the sheet is conveyed at a second timing is where the guide plates 502F and 502R already been determined to be in the moved state at least once.

Therefore, until the above-mentioned sampling time is measured at least once, the feeding of the sheet is not resumed during the time while the user further moves the guide plates 502F and 502R and adjusts the position of the guide plates 502F and 502R. Therefore, time is ensured for the user to adjust the positions of the guide plates 502F and 502R after placing the sheet on the manual feed tray 304, and the position of the sheet in the width direction can be regulated securely by the guide plates 502F and 502R. Thereby, skewing of the sheet is reduced, such that printing accuracy is enhanced and occurrence of jamming is reduced.

Further, problems such as the sheet being fed while the guide plates 502F and 502R are still being moved or the image forming job not being resumed for a predetermined time after the sheets are completely set can be reduced.

Second Embodiment

Next, a second embodiment of the present invention will be described. According to the second embodiment, a detection timing of the guide width in step S48 (refer to FIG. 11) is set to a different timing. Therefore, similar configurations as the first embodiment are not shown in the drawing or denoted with the same reference numbers.

Figure 12:
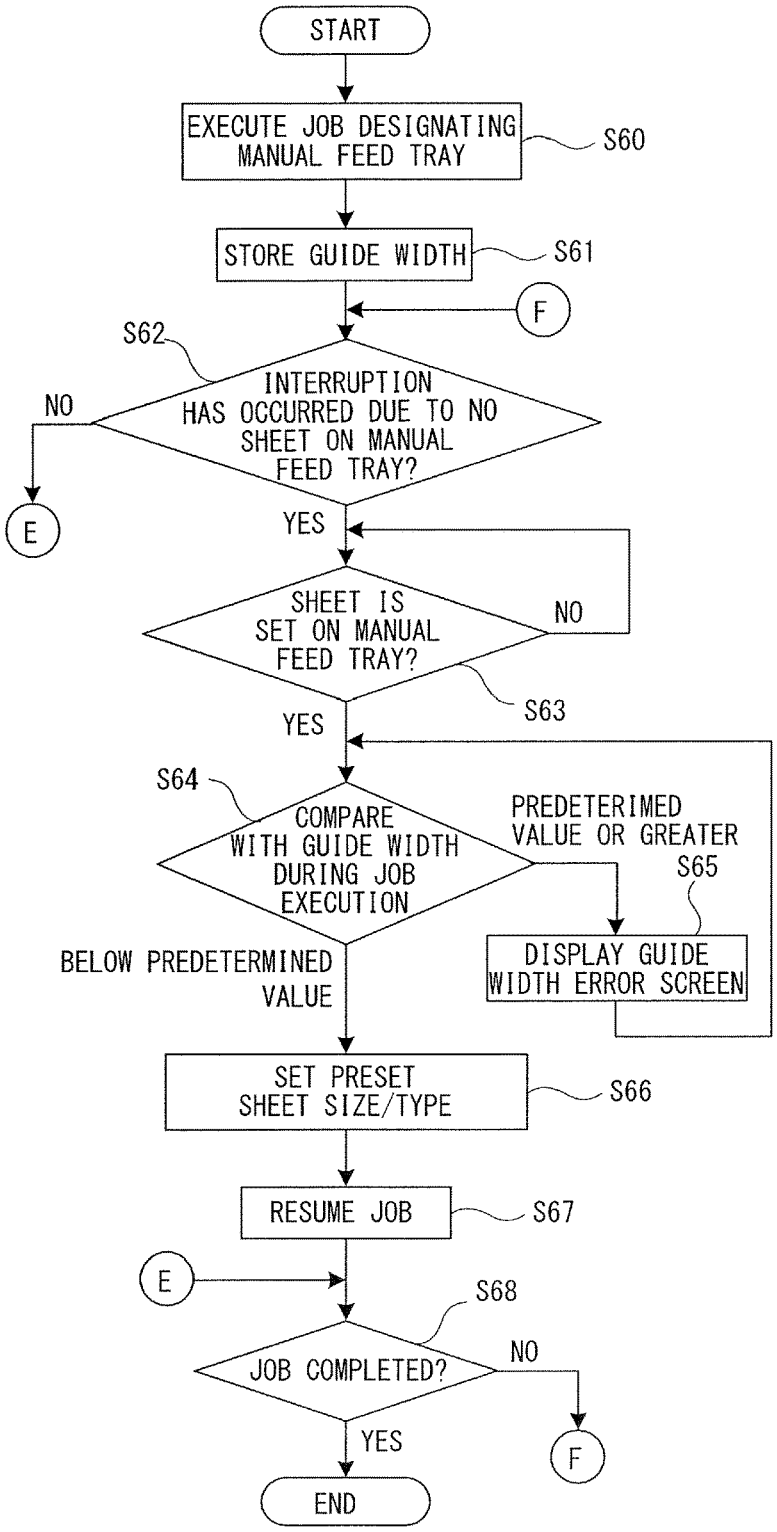
FIG. 12 is a flowchart illustrating a setting processing of a manually-fed sheet information during job interruption according to the second embodiment.

A setting processing of sheet information regarding the manually-fed sheet during job interruption according to the present embodiment will be described with reference to the flowchart illustrated in FIG. 12. In the flowchart of FIG. 12, it is assumed that the default setting corresponding to the manual feed tray 304 is set to fixed mode and the selected sheet size information is set to free size. The program for executing the setting processing is installed in the disk 211, expanded in the memory 202 during execution and executed under the control of the CPU 201.

At first, in a state where the manual feed tray 304 is designated by the user, the image forming job is executed (step S60), the CPU 201 stores the guide width in this state temporarily in the memory 202 based on the detection result of the guide width sensor 109 (step S61). In this state, as illustrated in FIG. 9E, the CPU 201 stores the guide width together with a job identifier in the memory 202. The position of the guide plates 502F and 502R in this state is a third position. The CPU 201 determines whether the image forming job is interrupted (step S62), and if it is determined that the image forming job is not interrupted (step S62: NO), the procedure advances to step S68. In step S68, the CPU 201 determines whether the image forming job has been completed (step S68). If the image forming job is completed (step S68: YES), the processing is ended. If the image forming job is not completed (step S68: NO), the procedure returns to step S62.

If it is determined that the image forming job is interrupted in step S62, the CPU 201 determines whether a sheet is supported on the manual feed tray 304 based on the detection result of the sheet presence sensor 504 (step S63). If it is determined that a sheet is supported (step S63: YES), the CPU 201 acquires the guide width in that state, that is, during job interruption, based on the detection result of the guide width sensor 109. Then, in step S61, the CPU 201 performs a check processing checking whether the guide width before job interruption temporarily stored in the memory 202 and the guide width during job interruption correspond (step S64). The position of the guide plates 502F and 502R during job interruption is a fourth position.

If the guide width before job interruption and the guide width during job interruption differ greatly according to the check processing (step S64: equal to or greater than a predetermined value), the CPU 201 causes the display portion 203 to display a guide width error screen prompting the user to set the selected sheet size information again (step S65). If the guide width before job interruption and the guide width during job interruption do not differ greatly (step S64: smaller than predetermined value), the selected sheet size information and the selected sheet type information are respectively stored as determined sheet size information and determined sheet type information in the memory 202 (S66). In the present embodiment, if the difference between the guide width before job interruption and the guide width during job interruption is 10 mm or greater, the check processing is determined as NG, and if the difference is smaller than 10 mm, the check processing is determined as OK, but this threshold can be set arbitrarily.

Then, the CPU 201 outputs an instruction to resume the image forming job (step S67). Thereby, for example, the pickup roller 304*a* is driven and the sheet supported on the manual feed tray 304 is fed. If it is determined in step S68 that the image forming job is completed (step S68: YES), the processing is ended.

As described, according to the present embodiment, even if job interruption occurs, only a free size sheet that corresponds to the guide width during entry of the job will be fed. Therefore, even if the user erroneously operates the guide plates 502F and 502R in midway of the image forming job, the guide plates 502F and 502R can be set to the correct position. Thereby, a product with consistency can be produced both before and after job interruption.

Third Embodiment

Next, a third embodiment of the present invention is described. According to the third embodiment, one process is added to the setting of the manually-fed sheet information during job interruption of the first embodiment. Therefore, the configurations similar to the first embodiment are not shown in the drawing or denoted with the same reference numbers.

Figure 13:
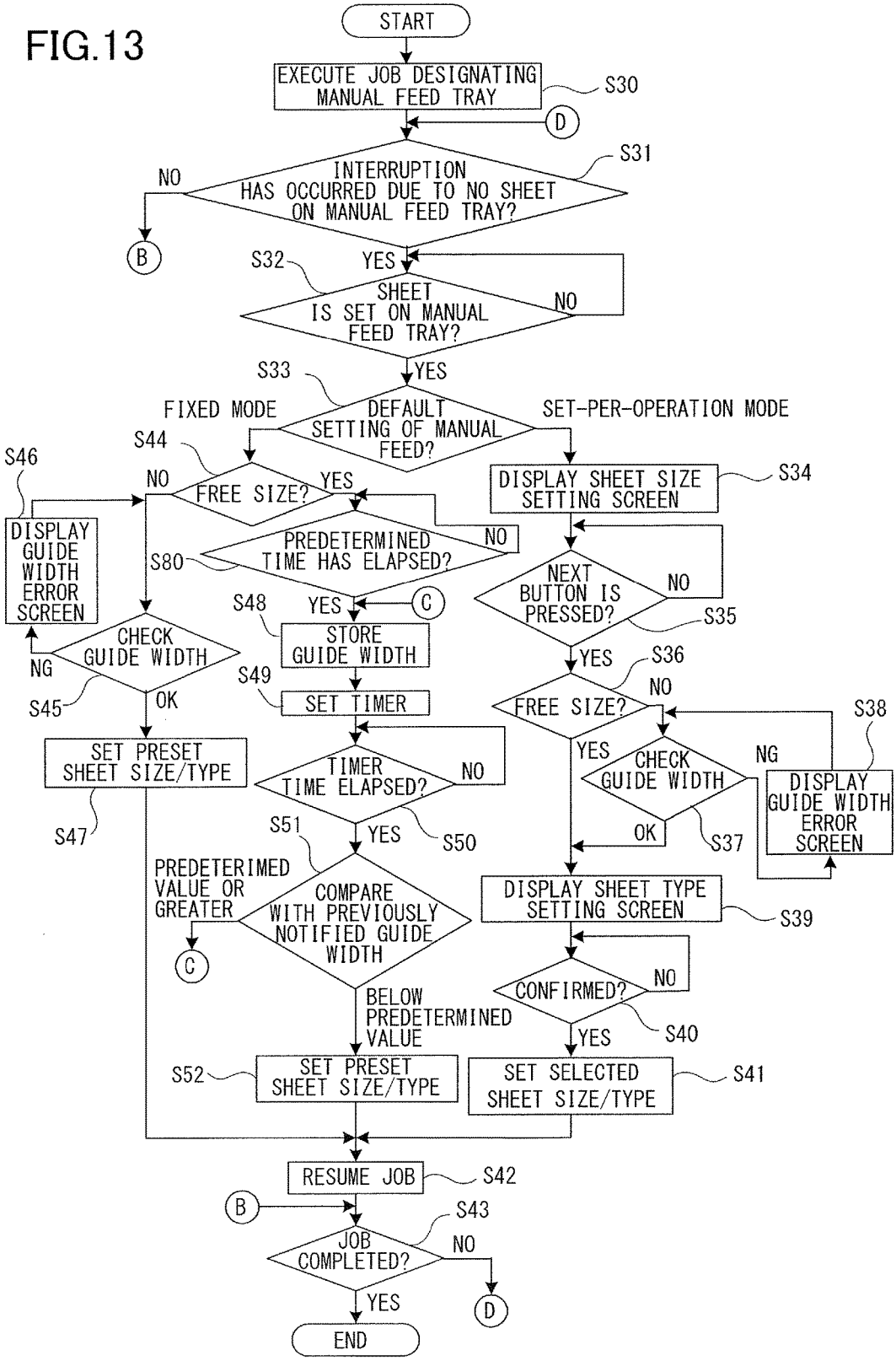
FIG. 13 is a flowchart illustrating a setting processing of a manually-fed sheet information during job interruption according to a third embodiment.

FIG. 13 is a flowchart illustrating a setting processing of information regarding manually-fed sheet during job interruption according to the present embodiment, and step S80 is added before step S48 of the flowchart illustrated in FIG. 11 of the first embodiment. Other than step S80, the present flowchart is the same as the flowchart illustrated in FIG. 11, so only step S80 will be described.

If it is determined in step S44 that the selected sheet size information is free size (step S44: YES), the CPU 201 measures a predetermined time using the timer 212 (refer to FIG. 6), for example (step S80). The predetermined time should be set to an assumed time from when the user places the sheet on the manual feed tray 304 to when the user operates the guide plates 502F and 502R, and it is set to 1000 msec, for example. When it is determined that a predetermined time has elapsed (step S80: YES), the CPU 201 stores the guide width temporarily in the memory 202 based on the detection result of the guide width sensor 109 (step S48). Then, the CPU 201 starts measuring time using the timer 212 (refer to FIG. 6) (step S49). In the present embodiment, the sampling time measured by the timer 212 is set to 200 msec, but the sampling time can be changed arbitrarily.

The CPU 201 determines whether the sampling time set in the timer 212 has elapsed (step S50), and if the sampling time has elapsed (step S50: YES), the procedure advances to step S51. In step S51, the CPU 201 executes a movement determination processing in which the guide width temporarily stored in the memory 202 in step S48 and the guide width at the point of time when sampling time has elapsed are executed. If the difference between the guide widths is equal to or greater than a predetermined value, which is 5 mm according to the present embodiment (step S51: equal to or greater than predetermined value), the procedure returns to step S48. If the difference between guide widths is smaller than a predetermined value (step S51: below predetermined value), the CPU 201 stores the selected sheet size information and the selected sheet type information (illustrated in FIG. 9B, for example) as the determined sheet size information and the determined sheet type information in the memory 202 (step S52). Thereafter, the CPU 201 resumes the image forming job (step S42).

As described, according to the present embodiment, in a state where the sheet presence sensor 504 detects the sheet and enters the measurement start state, the procedure waits for the elapse of predetermined time in step S80, before measuring the sampling time. Therefore, the time required for the user to operate the guide plates 502F and 502R after the sheet is placed on the manual feed tray 304 is assumed as the predetermined time, and a shorter sampling time can be set. The sampling time functions only as a time for determining whether the guide plates 502F and 502R have been moved by vibration or have been moved by the user.

According to this configuration, whether the user has moved the guide plates 502F and 502R can be determined with better responsiveness, and both the improvement of printing accuracy and enhancement of productivity are realized.

According to all the embodiments described above, the sampling time can be set freely. Further, a trailing edge regulating plate configured to regulate the position of a trailing edge of the sheet supported on the manual feed tray 304 can be provided, and the timing of setting the determined sheet size information can be changed based on the movement of the trailing edge regulating plate serving as a regulating portion.

OTHER EMBODIMENTS

The present invention can also be realized by providing a program realizing one or more functions of the above-described embodiments through a network or a storage medium to a system or an apparatus and having one or more processors of the system or the apparatus perform processing to read and execute the program. The present invention can also be realized by a circuit (such as an ASIC) that implements one or more of the above-described functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-085338, filed Apr. 24, 2017, which is hereby incorporated by reference wherein in its entirety.

What is claimed is:

1. An image forming apparatus comprising:

a sheet supporting portion on which a sheet is supported;

a regulating portion configured to be movable with respect to the sheet supporting portion, and regulate a position of the sheet supported on the sheet supporting portion;

a feeding portion configured to feed the sheet supported on the sheet supporting portion;

an image forming unit configured to form an image on the sheet fed from the sheet supporting portion;

a sheet detection unit configured to detect that a sheet is supported on the sheet supporting portion; and a control unit configured to execute, in a state where an image forming job in which an image is formed by the image forming unit is interrupted, a drive processing of the feeding portion such that (a) the feeding portion is driven at a first timing if the regulating portion is not set to a moved state within a predetermined period of time from when the sheet detection unit has detected the sheet, and (b) the feed portion is driven at a second timing later than the first timing if the regulating portion is set to the moved state within the predetermined period of time from when the sheet detection unit has detected the sheet.

2. The image forming apparatus according to claim 1, wherein after the sheet detection unit has detected the sheet, the control unit starts measurement of time and is set to a measurement start state, and drives the feeding portion at the first timing if the regulating portion is not set to the moved state after the control unit is set to the measurement start state, and the control unit drives the feeding portion at the second timing later than the first timing if the regulating portion is set to the moved state after the control unit is set to the measurement start state.

3. The image forming apparatus according to claim 2, wherein during the drive processing, if the regulating portion is set to the moved state before a predetermined sampling time has elapsed after the control unit is set to the measurement start state, the control unit resets measurement of time and performs measurement of the sampling time again, the first timing is a timing based on end of measurement of the sampling time for a first time, and the second timing is a timing based on end of measurement of the sampling time for a plurality of times.

4. The image forming apparatus according to claim 3, wherein the control unit starts measurement of the sampling time after a predetermined time has elapsed from the start of the measurement start state.

5. The image forming apparatus according to claim 3, further comprising a position detection unit configured to detect a first position which is a position of the regulating portion in a state where the sheet detection unit has detected the sheet and the control unit has been set to the measurement start state, and a second position which is a position of the regulating portion in a state where the sampling time has elapsed after the control unit is set to the measurement start state, wherein the control unit determines that the regulating portion is set to the moved state if a difference between the first and second positions in the drive processing has become equal to or greater than a predetermined value, and determines that the regulating portion is in a stopped state if the difference is smaller than the predetermined value.

6. The image forming apparatus according to claim 2, further comprising a position detection unit configured to detect a third position which is a position of the regulating portion in a state where the image forming job is entered, and a fourth position which is a position of the regulating portion in a state where the measurement start state is set, wherein the control unit determines that the regulating portion is set to the moved state if a difference between the third and fourth positions during the drive processing has become equal to or greater than a predetermined value, and determines that the regulating portion is in a stopped state if the difference is smaller than the predetermined value.

7. The image forming apparatus according to claim 2, further comprising a storage portion configured to store a first information regarding sheet size associated with the sheet supporting portion, a second information indicating which mode is selected between a manual setting mode in which the first information is not set automatically if the sheet detection unit detects a sheet and a fixed mode in which the first information is set automatically to a preset value if the sheet detection unit detects a sheet, and a third information indicating that an omitted setting in which entry of the first information is omittable is effective, wherein the measurement start state is a state where the fixed mode is selected, the omitted setting is indicated to be effective and the sheet detection unit has detected a sheet.

8. The image forming apparatus according to claim 1, wherein the regulating portion is configured to move in a width direction orthogonal to a sheet feeding direction, and regulate a position of an edge portion in the width direction of the sheet supported on the sheet supporting portion.

9. The image forming apparatus according to claim 1, wherein the sheet supporting portion is a manual feed tray on which the sheet is fed manually.

10. A method for controlling an image forming apparatus configured to regulate a position of a sheet supported on a sheet supporting portion by a regulating portion, the method comprising:

acquiring information, by a control unit, indicating that an image forming job in which an image forming unit is caused to form an image is in an interrupted state;

determining, by the control unit, whether a regulating portion has been set to a moved state at least after a sheet detection unit detects that a sheet is supported on the sheet supporting portion; and driving, by the control unit, a sheet feeding portion configured to feed the sheet supported on the sheet supporting portion at a first timing if the control unit determines that the moved state is not detected within a predetermined period of time, and at a second timing that is later than the first timing if the control unit determines that the moved state has been detected within the predetermined period of time.

11. A non-transitory computer readable medium storing a program code configured to control an image forming apparatus that is configured to regulate a position of a sheet supported on a sheet supporting portion by a regulating portion, the program code comprising:

acquiring information, by a control unit, indicating that an image forming job in which an image forming unit is caused to form an image is in an interrupted state;

determining, by the control unit, whether a regulating portion has been set to a moved state at least after a sheet detection unit detects that a sheet is supported on the sheet supporting portion; and driving, by the control unit, a sheet feeding portion configured to feed the sheet supported on the sheet supporting portion at a first timing if the control unit determines that the moved state is not detected within a predetermined period of time, and at a second timing that is later than the first timing if the control unit determines that the moved state has been detected within the predetermined period of time.

* * * * *